United States Patent [19]

McWilliams

[11] 4,430,558

[45] Feb. 7, 1984

[54] ELECTRIC RADIANT HEATER UNIT FOR A GLASS CERAMIC TOP COOKER

[75] Inventor: Joseph A. McWilliams, Hadzor, England

[73] Assignee: Micropore International Ltd., Hadzor Droitwich, England

[21] Appl. No.: 285,484

[22] Filed: Jul. 21, 1981

[30] Foreign Application Priority Data

Jul. 22, 1980 [GB] United Kingdom ..... 8023929

[51] Int. Cl.[3] ..... H05B 3/68

[52] U.S. Cl. ..... 219/449; 219/461; 219/446; 219/463; 219/466; 337/394

[58] Field of Search ..... 219/445, 446, 449, 450, 219/452, 461, 462, 464, 466, 467; 337/294; 126/39 G, 39 H

[56] References Cited

U.S. PATENT DOCUMENTS

| | | | |
|---|---|---|---|
| 2,155,425 | 4/1939 | LaMere | 219/452 |
| 2,556,106 | 6/1951 | Roberts | 219/461 |
| 3,906,434 | 9/1975 | Clancy et al. | 337/394 |
| 3,909,592 | 9/1975 | Eide | 219/462 |
| 4,243,874 | 1/1981 | Fischer | 219/467 |
| 4,267,815 | 5/1981 | Gössler | 337/394 X |
| 4,327,280 | 4/1982 | McWilliams | 219/464 |

FOREIGN PATENT DOCUMENTS

| | | | |
|---|---|---|---|
| 2748109 | 5/1979 | Fed. Rep. of Germany | 219/449 |
| 2061679 | 5/1981 | United Kingdom | 219/449 |

*Primary Examiner*—Volodymyr Y. Mayewsky
*Attorney, Agent, or Firm*—Browdy and Neimark

[57] ABSTRACT

An electric radiant heater unit for a glass ceramic top cooker comprises two independently energizable heater elements supported on a base of electrical and thermal insulation material. A thermal cut-out device, which may be of the differential expansion type, extends from a peripheral wall of the unit across one element and across a zone normally occupied by at least a part of the other element. However, that zone of the heater unit heated by said one element is extended to influence substantially the entire effective length of the cut-out device, that is including that portion of the cut-out device which extends across the zone normally occupied by at least a part of the other element.

15 Claims, 8 Drawing Figures

ELECTRIC RADIANT HEATER UNIT FOR A GLASS CERAMIC TOP COOKER

BACKGROUND OF THE INVENTION

The present invention relates to electric radiant heater units of the kind used in glass ceramic top cookers. More particularly, the invention relates to such heater units which employ two or more heater elements in the same unit.

DESCRIPTION OF THE PRIOR ART

A glass ceramic top cooker is one in which a smooth top of glass ceramic overlies one or more generally circular electric heater elements supported on a layer of thermal and electrical insulating material such that the elements are spaced from the underside of the glass ceramic top of the cooker. In use, a utensil placed on the glass ceramic top above a heater element is heated by the transmission of heat from the element to and through the glass ceramic top by air conduction, convection and infra-red radiation. Such heater elements are referred to as radiant heaters. The insulating material substantially prevents heat being transmitted away from the heater element except towards the glass ceramic top and as the preferred materials for the top are essentially thermally non-conductive, only areas of the top which are directly exposed to the heater element will be heated. In order to prevent heat being transmitted to parts of the top not covered by a utensil placed thereon, a peripheral wall of insulating material is also normally provided around the heating element.

It is usual, and in some jurisdictions mandatory, in radiant heaters to include a thermal cut-out device to protect both the element and the glass ceramic top from overheating. While it is possible to design and construct a heater unit with a low watts density to obviate the need for a cut-out device, this leads to a slow cooking performance which is often unacceptable to the housewife. Thus, a thermal cutout device is desirable both from the point of view of safety and that of performance. Further, excessive temperatures can result in mechanical damage to or discolouration of the glass ceramic top. For example, a glass ceramic top can discolour if the temperature at the exposed surface exceeds 600° C. or if the temperature at the surface nearest to the heater element exceeds 700° C.

In radiant heater units which employ two or more adjacent heater elements of which one is of substantially higher thermal capacity than any of the others, we have found that a thermal cut-out device often can satisfactorily protect the unit from overheating if its response is limited to the heat generated by that larger element so long as the smaller element or elements are not energized independently. However, a problem exists if the other element or elements also have an influence. Typical cut-out devices are of elongate form, designed to extend across the heater unit, and it has been proposed in copending U.S. patent application No. 229,999, to which reference is directed, to design and construct an electric radiant heater unit having at least two adjacent heater elements of which at least one element is energisable independently of the other element or elements, in which a thermal cut-out device extends across said one element and across a zone normally occupied by said other element or elements, but is thermally isolated both from said one element and from said other element or elements such that it is operative in response only to heat generated by said one independently energisable element and effective only over that part of the cut-out device which extends across said one element. However, this arrangement has the disadvantage that part of the length of the cut-out device, which is said to be shielded from the influence of all of the heater elements, is in practice subjected to some heat and this can lead to the cut-out device operating when the temperature is either too high or too low.

It is an object of the present invention to obviate the aforementioned difficulties, this being accomplished according to the present invention by not only thermally isolating the thermal cut-out device from the influence of the other element or elements, but additionally exposing the cut-out device to the influence of the one element along as great a proportion of its length as possible.

SUMMARY OF THE INVENTION

According to the present invention there is provided an electric radiant heater unit comprising:

at least two heater elements arranged adjacent to one another, of which one element is energisable independently of the other element or elements; and a thermal cut-out device which extends from a peripheral wall of the unit across said one element and across a zone normally occupied by at least a part of at least one of said other elements, wherein that zone of the heater unit heated by said one element is extended to influence substantially the entire effective length of the cut-out device.

The one element and the other element or elements may be separated by a dividing wall to create at least two discrete cooking areas on the surface of the glass ceramic top of the cooker.

The zone heated by said one element is preferably extended by locating the cut-out device such that substantially the entire effective length thereof is exposed to radiation emitted by said one element. This is achieved, according to one embodiment of the invention, by extending said one heater element adjacent to the cut-out device across the zone normally occupied by said other element or elements. Preferably, said one element extends below the cut-out device. To shield the cut-out device from heat emitted by said other element or elements, a wall of thermal insulating material is positioned beneath the cut-out device and said other element or elements where the cut-out device extends across the zone normally occupied by said other element or elements.

According to a second embodiment of the invention, said zone is extended into an alcove which contains a length of the cut-out device that is not directly adjacent to the one element, the alcove being shaped to insulate the cut-out device from the other element or elements but to permit direct transmission of radiation from said one element to that end of the cut-out device remote from said one element. Preferably, the wall of the alcove is made of a thermal insulation material to shield the cut-out device from heat emitted by said other element or elements.

The alcove is preferably tapered to permit maximum exposure of the length of the cut-out device to said one element and maximum insulation of the remote end of the cut-out device from the other element or elements and external heat influences. In one embodiment, the cut-out device may also extend through a tapered opening in the dividing wall, the alcove being disposed on that side of the dividing wall remote from said one element. Preferably, the ratio of the area of said opening adjacent to the one element to the cross-sectional area of said cut-out device is in the range of from 5:1 to 20:1. However, in another embodimdent, the wall of the alcove extends into a gap formed in the dividing wall. Preferably, the ratio of the area of the alcove adjacent to the one element to the cross-sectional area of said cut-out device is in the range of from 5:1 to 20:1.

The present invention is particularly suited to heater units in which one heater element substantially surrounds another, for example in a circular heater unit having two concentric heater elements. However, the invention is also applicable where two heater elements are located adjacent to one another in the same unit, where the position of the cut-out device with respect to the unit is predetermined and cannot conveniently be moved to a position overlying one particular element.

The heater elements in units according to the present invention are preferably bare coiled wired supported in a microporous thermal insulation material. The cut-out device is generally of the differential expansion type, a suitable device comprising a quartz tube containing a length of Inconel wire and differential expansion between the tube and the wire operating a switch which de-energises the entire unit. Such a cut-out device is available from Therm-O-Disc Inc, Mansfield, Ohio, United States of America under the designation "12TB Limiter:.

For a better understanding of the present invention and to show more clearly how it may be carried into effect reference will now be made, by way of example, to the accompanying drawings in which:

DESCRIPTION OF PREFERRED EMBODIMENTS

Figure 1:
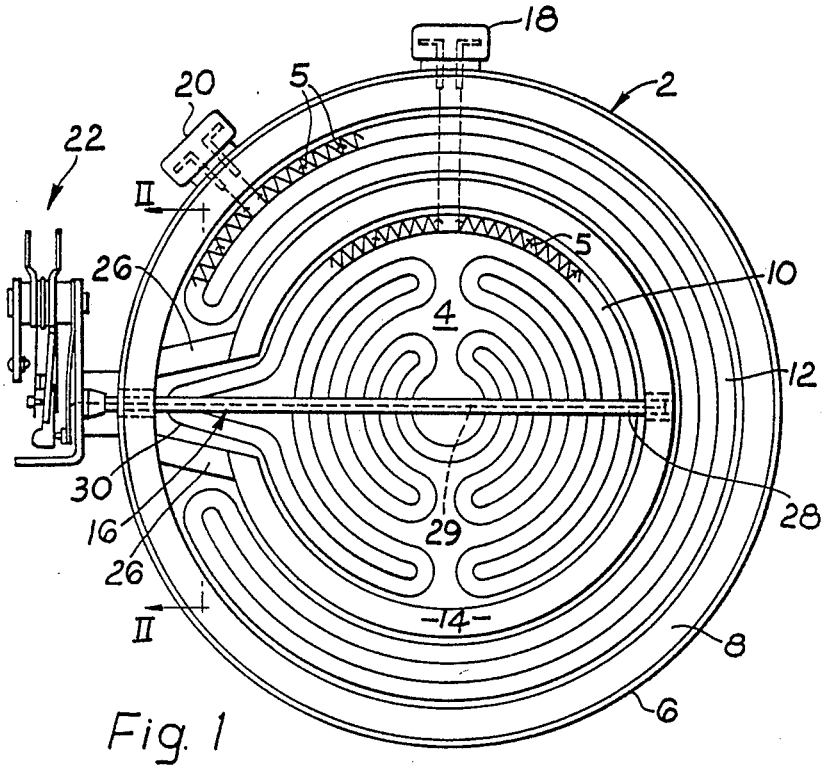
FIG. 1 is a plan view of a first embodiment of a heater unit according to the present invention.

The same reference numerals are used throughout the description and drawings to denote the same or similar parts.

Figure 3:
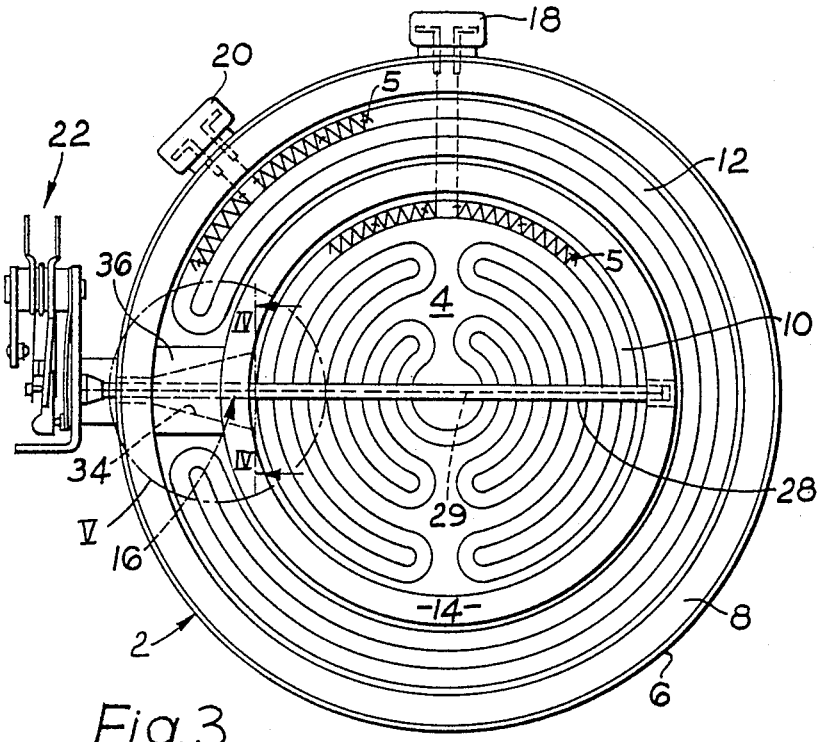
FIG. 3 is a plan view of a second embodiment of a heater unit according to the present invention.

The heater unit illustrated in each of FIGS. 1 and 3 comprises a metal dish 2 containing a base 4 of electrical and thermal insulating material such as that marketed by Micropore International Limited under the Trade Mark MICROTHERM. Against the side 6 of the dish there is located a peripheral wall 8 of thermal insulation, typically ceramic fibre material.

Set in grooves formed in the base 4 are two substantially concentric electric heater elements in the form of coils 10 and 12 which are separated from each other by a dividing wall 14, also typically of ceramic fibre material. Extending above the coils is a thermal cut-out device 16 which is operable to switch off both coils in the event of overheating.

Each coil is controllable independently by means of terminal connectors 18 and 20 enabling a relatively small circular pan or other utensil to be heated solely by the coil 10 and a larger similar utensil to be heated by both coils 10 and 12. Each coil is unprotected and is secured in the base 4 by means of staples 5. Each coil is preferably made from an iron-chromium-aluminium resistance heating wire which is preformed into shape by a method of the kind described in copending U.S. patent application No. 229,999.

The thermal cut-out device is of the differential expansion type and comprises a quartz tube 28 containing a length of Inconel wire 29. Differential expansion as a consequence of overheating operates a mechanical switch 22 to disconnect both coils 10 and 12 from the power source. The cut-out device need only be located over the coil 10, but to be reliably effective it must be thermally isolated from the coil 12. To achieve this zone heated by the coil 10 is extended such that the influence of the coil 10 is suffered directly by the entire effective length of the quartz tube 28. In the embodiment shown in FIGS. 1 and 2, the coil 10 includes a portion 30 which extends between portions 26 of the wall 14 to the peripheral wall 8. The thermal cut-out device 16 terminates in the dividing wall on the other side of the inner coil 10. The coil 12 terminates short of the wall portions 26 as shown in FIGS. 1 and 2.

It will be appreciated that the principle of using two separated and independently operable heating coils in a radiant heater of the kind described herein can be extended to all shapes of heater. The circular unit illustrated herein provides a heater having two different circular heating zones, but the same principle may be applied to square or rectangular heaters.

On a glass ceramic top cooker, however, where there is low lateral thermal conduction, it is advantageous to provide a dividing wall of thermal insulating material such as 14 in FIG. 1, to define distinct and separate heating zones. The dividing wall may be secured to the base 4 for example by means of pins (not shown) inserted into the thermal insulating material of the base. The dividing wall of FIG. 1 is circular and divides the heating area defined by the peripheral wall 8 into a central zone and an annular zone. Without a dividing wall, heat radiating from each coil would extend beyond the surface zone of the smooth top (not shown) immediately above the respective coil 10 or 12, with consequent wastage of heat when only one coil is in use. However, I have found in the case of the embodiment shown in FIGS. 1 and 2 that the loss of heat which results from the extension of the zone heated by the coil 10 in the manner shown and described is not noticeably detrimental to the performance of the heater. Moreover, we have found that the wall portions 26 effectively protect the cut-out device 16 from the influence of the coil 12 and thus the cut-out device operates at substantially the same limit temperature irrespective of whether the inner or both coils are energised.

Figure 2:
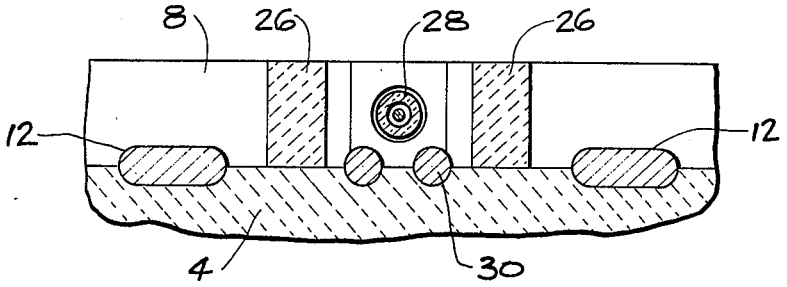
FIG. 2 is a detailed cross-section, to a larger scale, taken on line 11—11 of FIG. 1.
Figure 6:
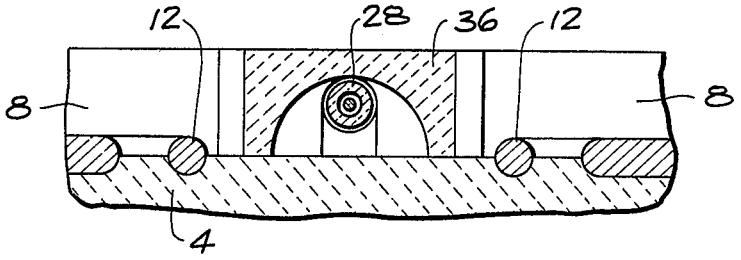
FIG. 6 is a detailed cross-section taken on line VI—VI of FIG. 5.

In the embodiment shown in FIGS. 3 to 6, the shape of the coil 12 is the same as that in FIGS. 1 and 2, but the coil does not include the portion 30. The influence of the coil 10 is in this case extended into an alcove formed by an opening in the form of an arch 32 in the dividing wall 14 (see FIG. 4) and a tunnel 34 in a block 36 of insulating material which is located between the walls 8 and 14 (see FIGS. 5 and 6). As shown, the arch is part-circular, but other shapes, e.g. rectangular, may be used. If desired, the ends of the block 36 may be keyed into the walls 8 and 14, but this is not shown in the drawings. The quartz tube 28 of the cut-out device 16 extends under the arch and through the tunnel 34 to the peripheral wall 8. As can be seen from FIGS. 5 and 6, the alcove is tapered to provide for direct transmission of radiation from the coil 10 to the entire length of the tube 28, and maximum insulation of the tube 28 from the coil 12 and external heat influences adjacent to the peripheral wall.

However, other configurations can be adopted, and the taper is not essential, but it is important that the mouth of the alcove facing the coil 10 is substantially larger than the cross-section of the tube 28 to enable the direct passage of radiation from the coil 10 to the end of the tube 28 adjacent to the peripheral wall 8. We have found that particularly advantageous results are obtained when the ratio of the area of the opening to the cross-sectional area of said cut-out device is in the range of from 5:1 to 20:1. The opening at the other end of the alcove should be just sufficiently large for the tube 28 of the cut-out device to pass through and we have found that a width of 6 mm is acceptable. Due to the manner in which the cut-out device extends above the coil 10, it is preferable that the topmost surface of the alcove is horizontal, although it is possible to depart from the horizontal where circumstances permit. It will be clear to a person skilled in the art that the preferred shape of the alcove will vary from one application to another, e.g. with varying diameters of the heater unit. However, it is a simple matter involving no inventive ability to conduct a series of experiments in order to determine the best shape of the alcove for any particular application.

Figure 8:
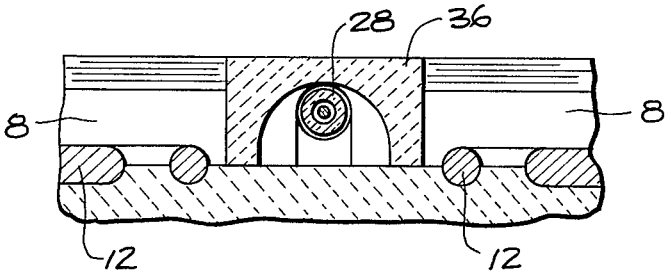
FIG. 8 is a detailed cross-section taken on line VIII—VIII of FIG. 7.
Figure 5:
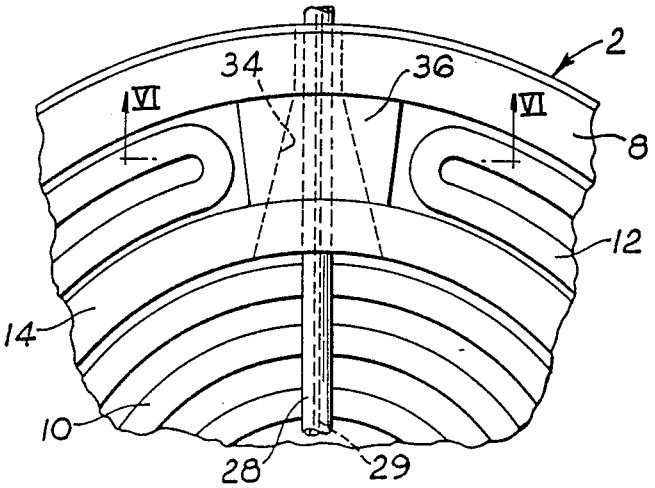
FIG. 5 is a detailed plan view of the area V indicated in FIG. 3.
Figure 7:
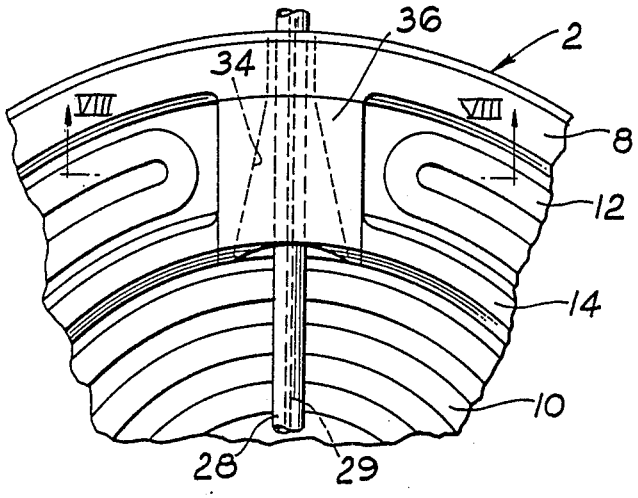
FIG. 7 is a detailed plan view of a modified version of the area V indicated in FIG. 2.

The insulating material forming the block 36 can be made of the same material as the walls 8 and 14, that is typically a ceramic fibre material. Alternatively, the block 36 can be formed in a microporous insulation material such as that marketed by Micropore International Limited under the Trade Mark MICROTHERM. As shown in FIG. 5, the external shape of the block 36 is arcuate section which enables a plurality of such blocks to be cut from an annular moulding. Another alternative, as shown in FIGS. 7 and 8, is to make the block generally rectangular, but with arcuate radially inner and outer ends which enables a number of such blocks to be cut from a panel or strip of insulating material. The side walls of the block 36 are shown flat, but may be curved to permit transmission of radiation from the coil 12 along converging paths past the side walls to reduce the size of the unheated region, or cold spot, created by the termination of the coil 12 on either side of the block 36. The relative thinness of insulation provided by the block 36 between the alcove and the coil 12 adjacent to the dividing wall 14, by virtue of the shape of the block, is acceptable because, in this region, the cut-out device will be influenced predominantly by the coil 10 and it is near the peripheral wall 8 that the cut-out device must be particularly efficiently protected from the influence of the coil 12, which in this region is closer than the coil 10.

A further unheated region or cold spot may arise as a result of the presence of the dividing wall 14. To reduce or eliminate this further cold spot, the upper part of the dividing wall 14 may be tapered as shown in FIG. 7 in order to reduce the width of the dividing wall where, in use, it contacts the underside of the glass ceramic top of the cooker. Similarly, if desired, the radially inner edge of the peripheral wall 8 may be tapered, but clearly it is undesirable to taper the radially inner edge of the wall 8 or the radially outer edge of the wall 14 in the region of the block 36 as illustrated in FIG. 7.

Figure 4:
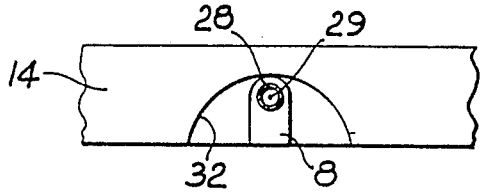
FIG. 4 is a detailed cross-section, to a larger scale, taken on line IV—IV of FIG. 3.

The embodiment shown in FIGS. 7 and 8 is a modification of the embodiment shown in FIG. 4 with the block 36 being substantially rectangular and extending into a gap formed in the dividing wall 14. In this case, it is unnecessary to cut an arch-shaped opening in the dividing wall and the radially inner opening of the alcove may be directly formed with an opening having an area from 5 to 20 times larger than the cross-sectional area of the tube 28 of the cut-out device.

I claim:

1. An electric radiant heater unit of the type comprising:
   - a support of thermal insulating material, the support having a peripheral wall;
   - at least first and second heater elements arranged adjacent to one another on the support;
   - a dividing wall of thermal insulating material separating said first and second heater elements;
   - means for energising said first heater element independently of said second heater element; and
   - a thermal cut-out device which extends from said peripheral wall across said first heater element and across a zone normally occupied by at least a part of said second heater element,
   - wherein the improvement comprises extending a zone of the heater unit which is heated by said first heater element such that substantially the entire effective length of the cut-out device is influenced by said first heater element.

2. A heater unit according to claim 1, wherein the cut-out device is located such that substantially the entire effective length thereof is exposed to radiation emitted by said first heater element.

3. A heater unit according to claim 2, wherein said first heater element extends adjacent to the cut-out device across the zone normally occupied by said second heater element.

4. A heater unit according to claim 3, wherein said first heater element extends below the cut-out device.

5. A heater unit according to claim 4, wherein a wall of thermal insulating material is positioned between the cut-out device and said second heater element where the cut-out device extends across the zone normally occupied by said second heater element to shield the cut-out device from heat emitted by said second heater element.

6. A heater unit according to claim 2, wherein said zone is extended into an alcove which contains a length of the cut-out device that is not directly adjacent to said first heater element, said alcove being shaped to insulate the cut-out device from said second heater element and to permit direct transmission of radiation from said first heater element to that end of the cut-out device remote from said first heater element.

7. A heater unit according to claim 6, wherein the wall of the alcove is made of a thermal insulation material to shield the cut-out device from heat emitted by said second heater element.

8. A heater unit according to claim 6, wherein the alcove is tapered to permit maximum exposure of the length of the cut-out device to said first heater element and maximum insulation of the remote end of the cut-out device from said second heater element and external heat influences.

9. A heater unit according to claim 8, wherein the cut-out device extends through a tapered opening in the dividing wall, the alcove being disposed on that side of the dividing wall remote from said first heater element.

10. A heater unit according to claim 9, wherein the ratio of the area of said opening adjacent to said first heater element to the cross-sectional area of said cut-out device is in the range of from 5:1 to 20:1.

11. A heater unit according to claim 8, wherein the wall of the alcove extends into a gap formed in the dividing wall.

12. A heater unit according to claim 11, wherein the ratio of the area of said alcove adjacent to said first heater element to the cross-sectional area of said cut-out device is in the range of from 5:1 to 20:1.

13. A heater unit according to claim 1, wherein said first heater element comprises a substantially circular central element and said second heater element comprises a substantially annular element extending around the circular element and concentric therewith.

14. An electric radiant heater unit of the type comprising:

a support of thermal insulating material, the support having a peripheral wall;

at least first and second heater elements arranged adjacent to one another on the support;

a dividing wall of thermal insulating material separating said first and second heater elements;

means for energising said first heater element independently of said second heater element; and a thermal cut-out device which extends from said peripheral wall across said first heater element and across a zone normally occupied by at least a part of said second heater element, wherein the improvement comprises extending said first heater element below said cut-out device across the zone normally occupied by said second heater element such that substantially the entire effective length of the cut-out device is exposed to radiation emitted by said first heater element.

15. An electric radiant heater unit of the type comprising:

a support of thermal insulating material, the support having a peripheral wall;

at least first and second heater elements arranged adjacent to one another on the support; a dividing wall of thermal insulating material separating said first and second heater elements;

means for energising said first heater element independently of said second heater element; and a thermal cut-out device which extends from said peripheral wall across said first heater element and across a zone normally occupied by at least a part of said second heater element, wherein the improvement comprises extending a zone of the heater unit which is heated by said first heater element into an alcove which contains a length of the cut-out device that is not directly adjacent to said first heater element, said alcove being shaped to insulate the cut-out device from the second heater element and to permit direct transmission of radiation from said first heater element to that end of the cut-out device remote from said first heater element.

* * * * *